US006336242B1

(12) United States Patent
Tseng

(10) Patent No.: US 6,336,242 B1
(45) Date of Patent: Jan. 8, 2002

(54) CARD TYPE PAPER TOOTHBRUSH

(76) Inventor: Chun-Lin Tseng, No.5, Chung-Hsing First Rd., Nan Tou, Nan Tou Hsien (TW)

( * ) Notice: Subject to any disclaimer, the term of this patent is extended or adjusted under 35 U.S.C. 154(b) by 0 days.

(21) Appl. No.: 09/526,084

(22) Filed: Mar. 15, 2000

(51) Int. Cl.[7] ..... A46B 9/04
(52) U.S. Cl. ..... 15/167.1; 15/187
(58) Field of Search ..... 15/167.1, 187, 15/188; 132/308, 309; D4/104, 111, 113, 132, 116, 134

(56) References Cited

U.S. PATENT DOCUMENTS

RE16,802 E * 11/1927 Withycombe
1,725,852 A * 8/1929 Cressler
1,739,324 A * 12/1929 Neissl
1,767,313 A * 6/1930 Salvucci
2,265,102 A * 12/1941 Cressler
2,294,747 A * 9/1942 Habeck et al.
2,750,614 A * 6/1956 Collins et al.
2,879,533 A * 3/1959 Ward
3,707,013 A * 12/1972 Erkers
3,881,211 A * 5/1975 Rhodes
4,617,694 A * 10/1986 Bori
4,821,359 A * 4/1989 Deziel et al.
D322,893 S * 1/1992 Kihara
6,116,252 A * 9/2000 Stelmach

* cited by examiner

*Primary Examiner*—Terrence R. Till
(74) *Attorney, Agent, or Firm*—Rosenberg, Klein & Lee

(57) ABSTRACT

A card type paper toothbrush is formed by cutting a paper plate to be a plane and then bending the plate so as to be formed as a card type paper toothbrush. The plate is installed with handle fold lines and a plurality of brush hair fold lines which are arranged in parallel. A plurality of lateral plates are formed by the handle fold lines, and a plurality of brush hair portions are spaced by the plurality of brush hair fold lines. Each brush hair portion is formed with a plurality of brush hair cut lines for cutting the brush hair portions into brush hairs of the toothbrush. The plate is further installed with a proper sticky surface. The lateral plates are wound as a handle by bending along the handle fold lines and then are fixed by the sticky surface. The multiple fold brush hair portions are formed by bending along the brush hair fold lines. A protruded seat is formed on the handle, and the brush hair portions wind around the protruded seat and then are fixed by the sticky surface, thereby forming a paper toothbrush.

4 Claims, 11 Drawing Sheets

CARD TYPE PAPER TOOTHBRUSH

FIELD OF THE INVENTION

The present invention relates to a card type paper toothbrush, and especially to a toothbrush which is formed by bending and assembled from a paper plate. Therefore, the cost can be reduced greatly without problem about environment pollution and can be carried conveniently.

BACKGROUND OF THE INVENTION

Disposable toothbrushes are frequently used in hotels and other public places. Since it is disposable, no health problem is necessary to be considered. However, the general used disposable toothbrush is made of plastics with a larger molding cost and a cost in material so that the whole manufacturing cost is increased. Therefore, the cost of the disposable toothbrush can not be reduced effectively. Moreover, the toothbrush made of plastics is difficult to be decomposed in nature environment so as to induce the problem in environment pollution. Therefore, it is apparent that the general used disposable toothbrush has some defect being necessary to be improved.

SUMMARY OF THE INVENTION

Accordingly, the primary object of the present invention is to provide a card type paper toothbrush which is disposable, and can be thrown away after it is used once. No trouble in health occurs. The present invention is made of a paper plate with a lower molding cost, further, the cost of paper is low. Therefore, the manufacturing cost is reduced greatly. Since the disposable toothbrush is only used once, no waste occurs. Furthermore, since the paper can be decomposed in a natural environment, no problem of environment pollution occurs. And, before assembling, the present invention is a thin plate and thus only occupies a smaller space, so that it is easily portable.

The various objects and advantages of the present invention will be more readily understood from the following detailed description when read in conjunction with the appended drawing.

DETAILED DESCRIPTION OF THE PREFERRED EMBODIMENTS

Figure 1:
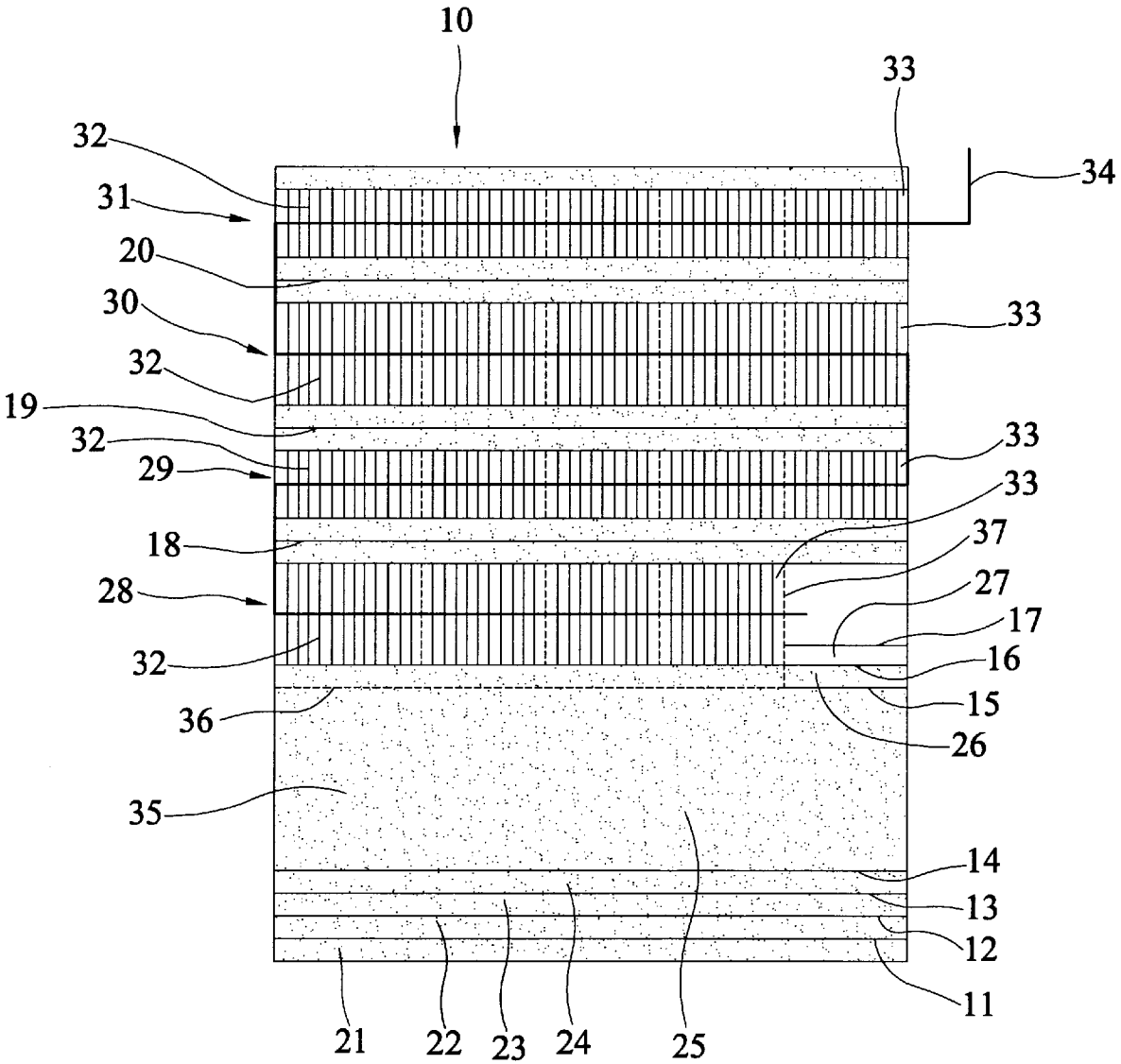
FIG. 1 is an exploded view of the present invention.

With reference to FIG. 1, an exploded view of the present invention is illustrated. The object of the present invention is to provide a card type paper toothbrush. At first, a paper is cut to be formed as a plane as that shown in FIG. 1, and then it is further bent to be formed as a cubic shape shown in FIG. 11. Thus, the card type paper toothbrush of the present invention is formed.

As shown in FIG. 1, the card type paper toothbrush of the present invention includes an approximately oblong plate 10. the plate 10 is installed with a plurality of parallel handle fold lines 11, 12, 13, and 14, seat fold lines 15, 16 and 17, and brush hair fold lines 18, 19 and 20. The handle fold lines 11, 12, 13, and 14 serve to be formed with a first lateral plate 21, a second lateral plate 22, a third lateral plate 23, a fourth lateral plate 24 and a fifth lateral plate 25. A first protruding plate 26 and a second protruding plate 27 are formed between the seat fold lines 15, 16 and 17. A first brush hair portion 28, a second brush hair portion 29, a third brush hair portion 30 and a fourth brush hair portion 31 are formed between the brush hair fold lines 18, 19 and 20. the brush hair portions 28, 29, 30 and 31 are formed with a plurality of brush hair cut lines 32 so as to cut the brush hair portion into a plurality of brush hairs 33. A tear-able tooth wire 34 is formed in the brush hair portions 28, 29, 30 and 31. The tooth wire 34 penetrates through the brush hair portions 28, 29, 30 and 31. One end of the tooth wire 34 protrudes out of the plate 10, and a further first cut line 36 is installed on the plate 10. the first cut line 36 is placed between the fifth lateral plate 25 and the first brush hair portion 28 and is connected to the seat fold line 15. One end of the first cut line 36 is connected to the second cut line 37. The second cut line 37 is vertical to the first cut line 36. Other than the brush hair portions 28, 29, 30 and 31 and the right side of the second cut line 37, the plate 10 is coated with a proper sticky surface 35.

Figure 2:
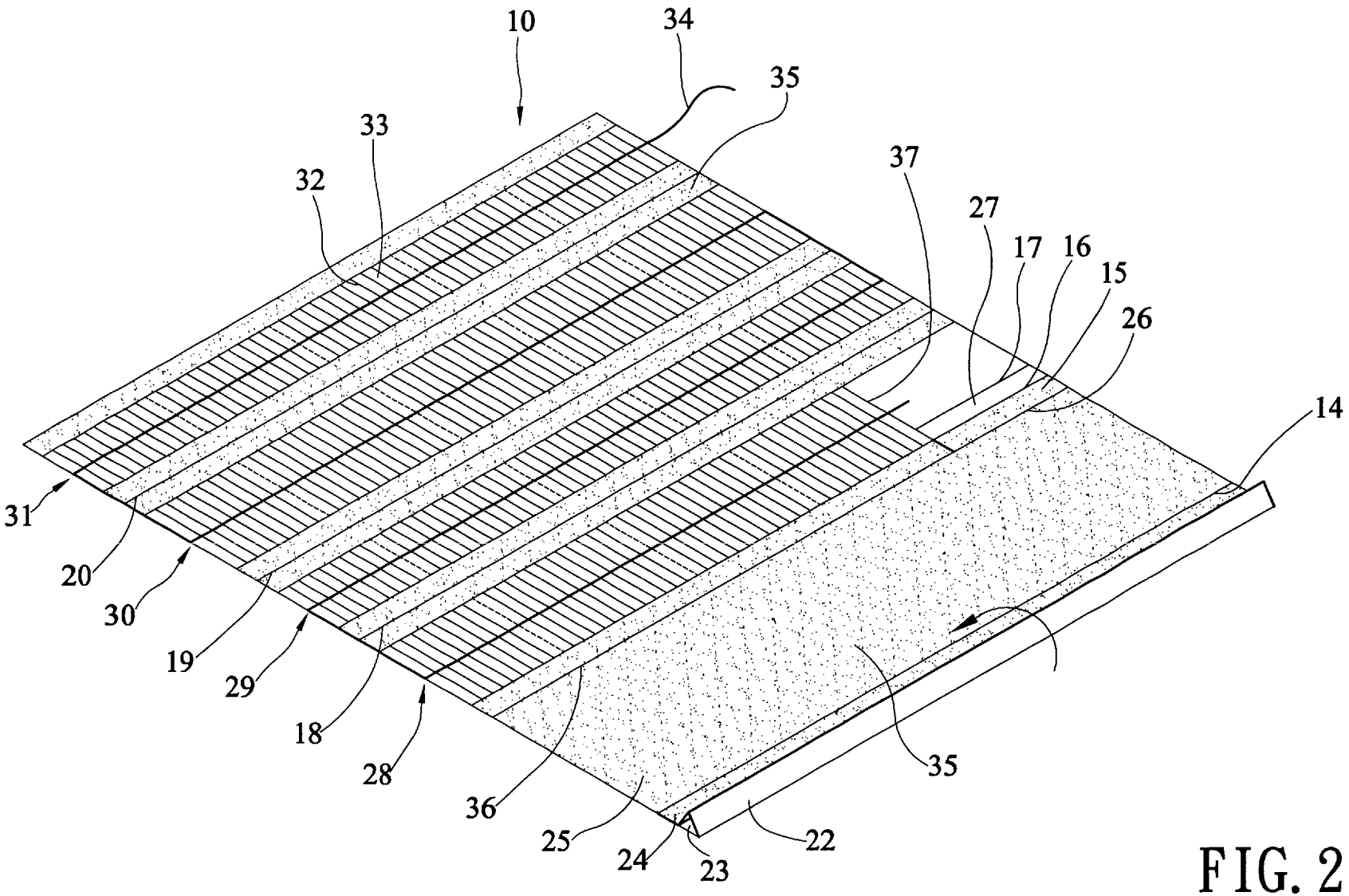
FIG. 2 is a first schematic view showing the assembly of the present invention.
Figure 3:
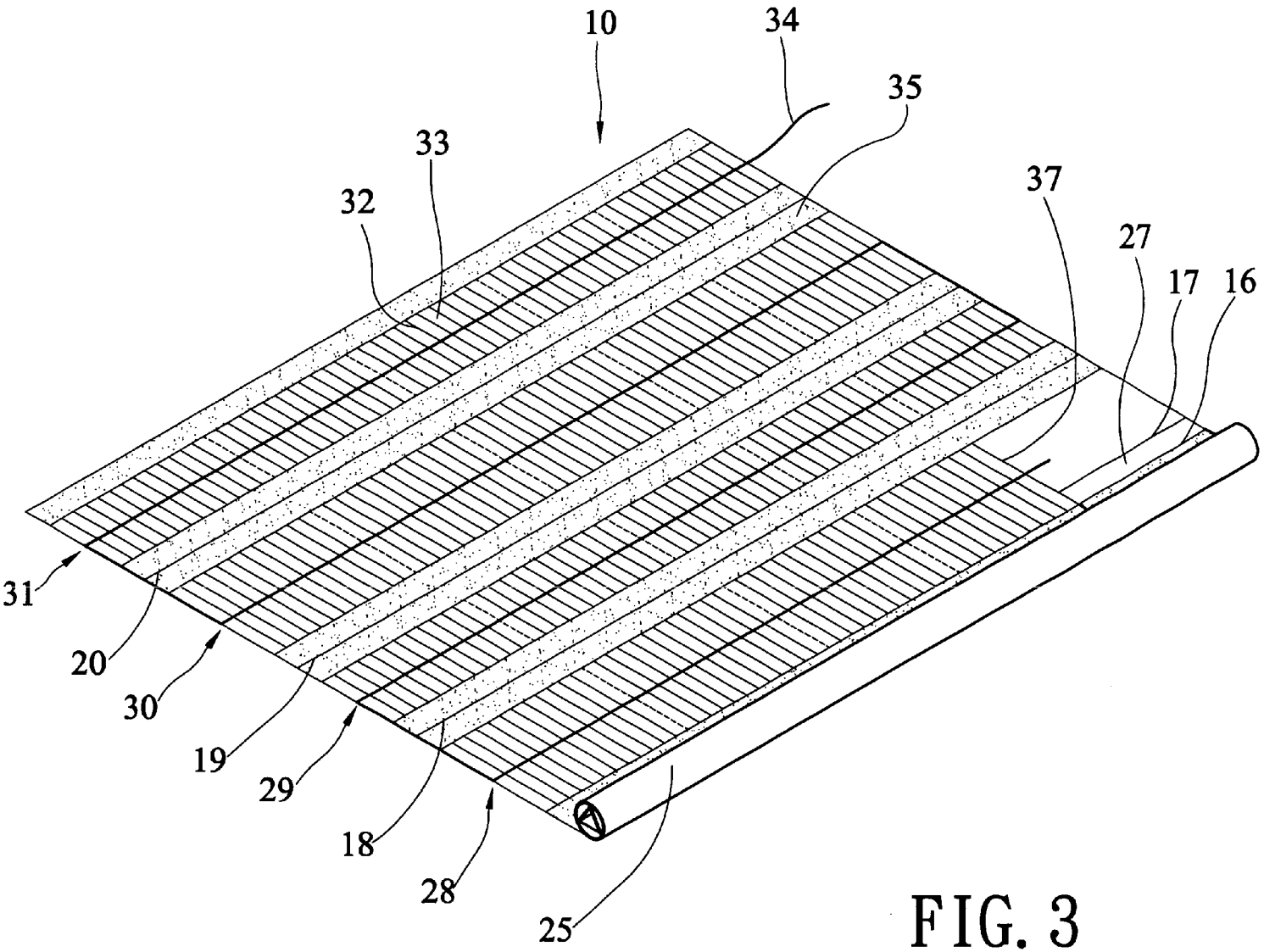
FIG. 3 is a second schematic view showing the assembly of the present invention.
Figure 4:
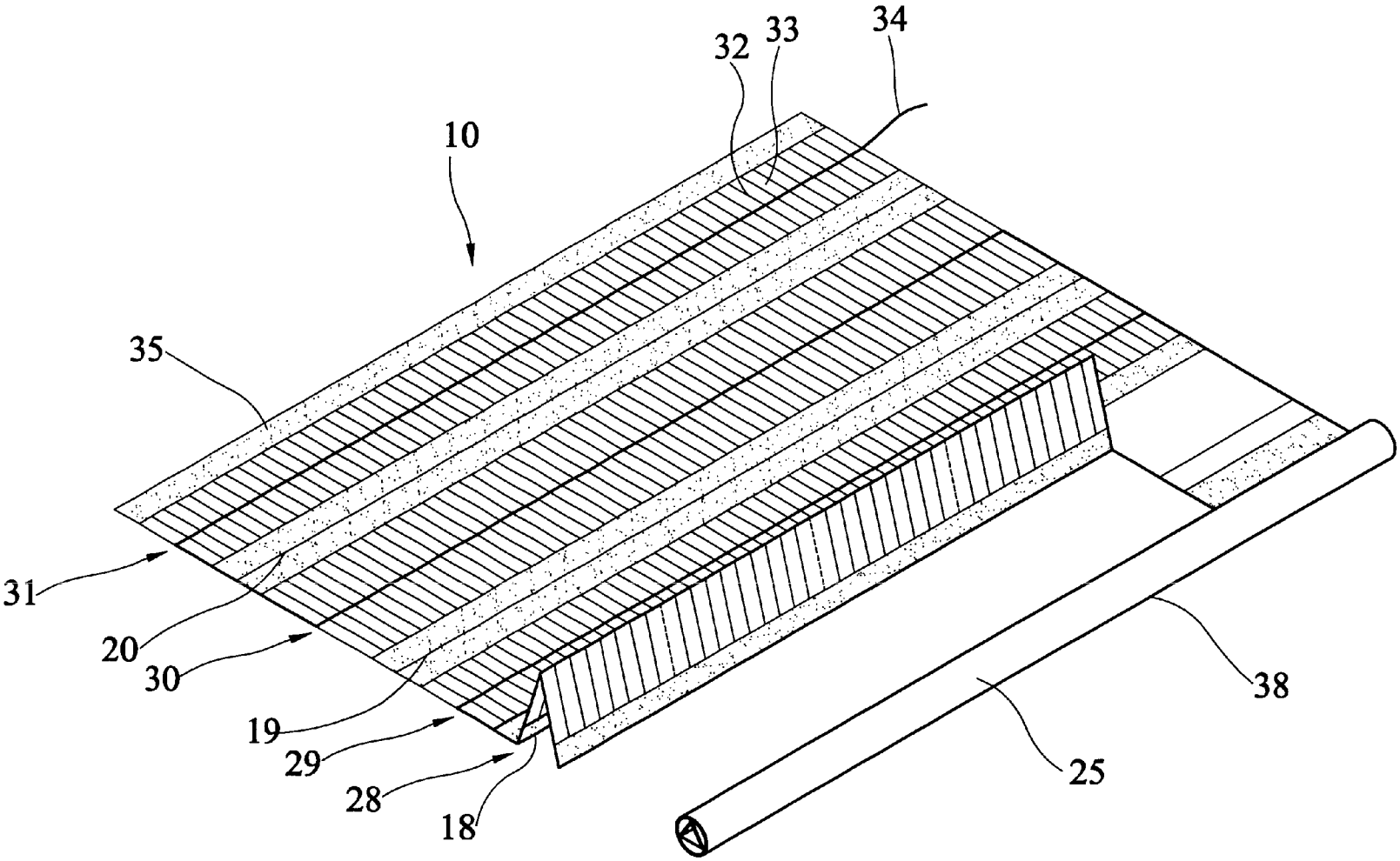
FIG. 4 is a third schematic view showing the assembly of the present invention.
Figure 5:
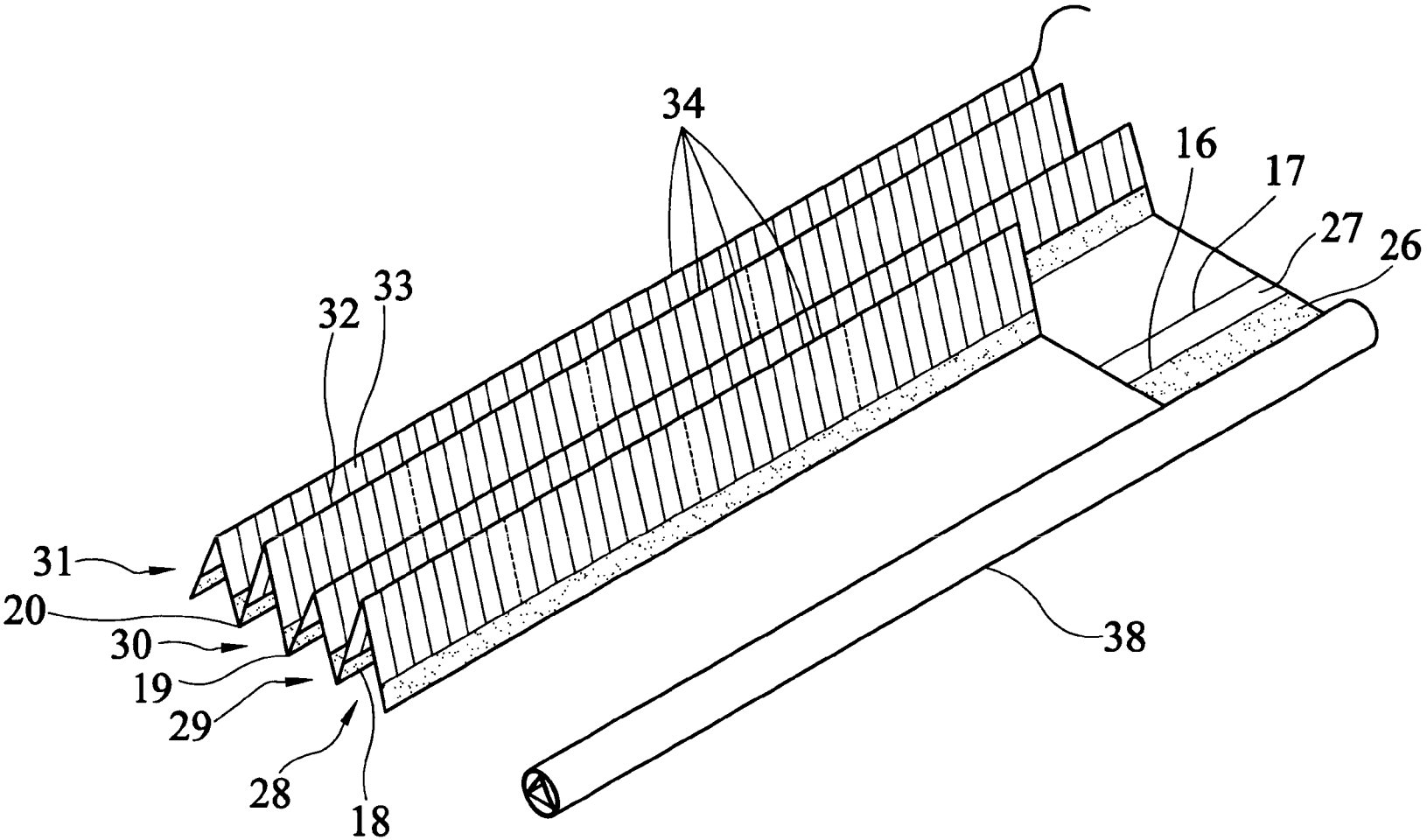
FIG. 5 is a fourth schematic view showing the assembly of the present invention.
Figure 6:
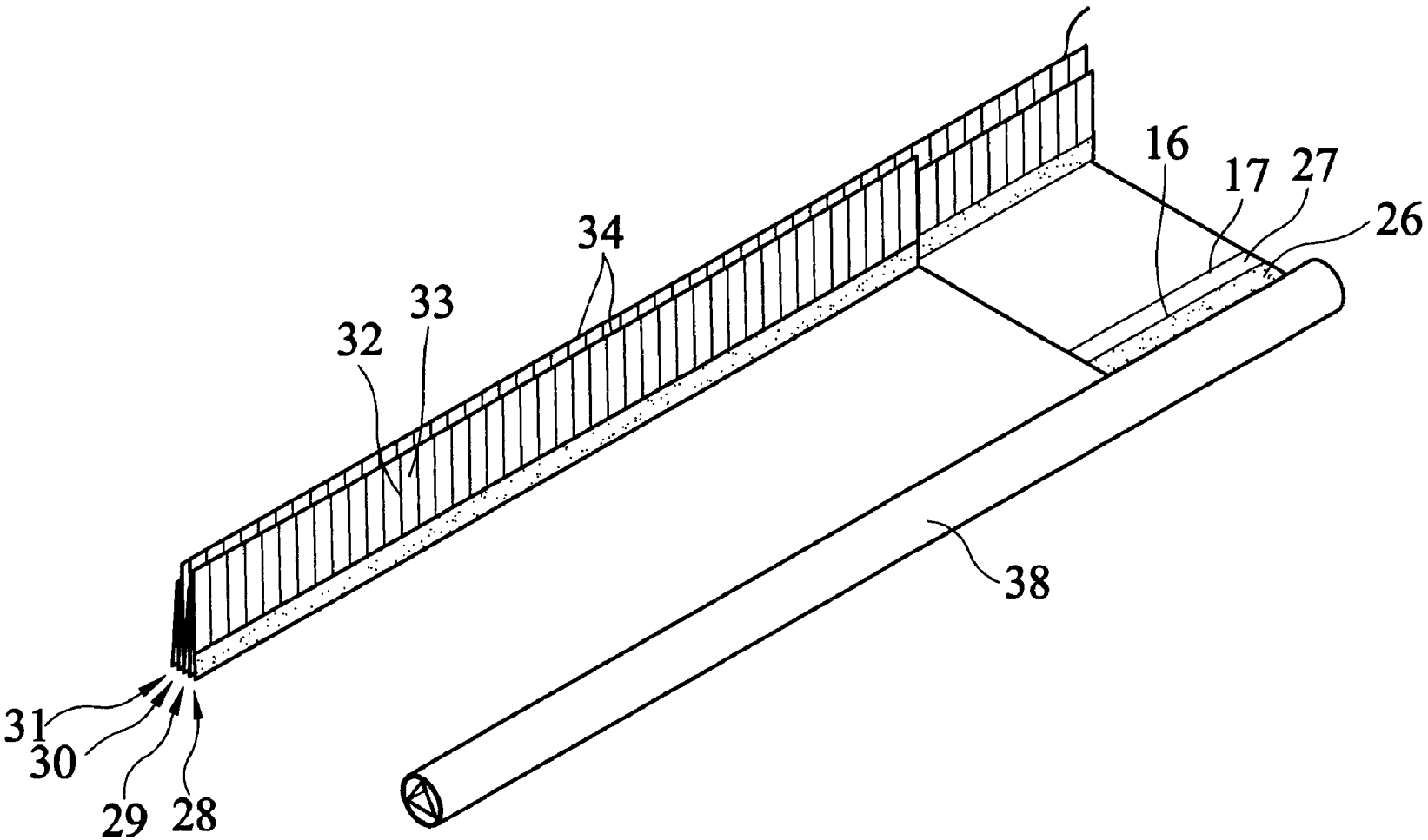
FIG. 6 is a fifth schematic view showing the assembly of the present invention.
Figure 7:
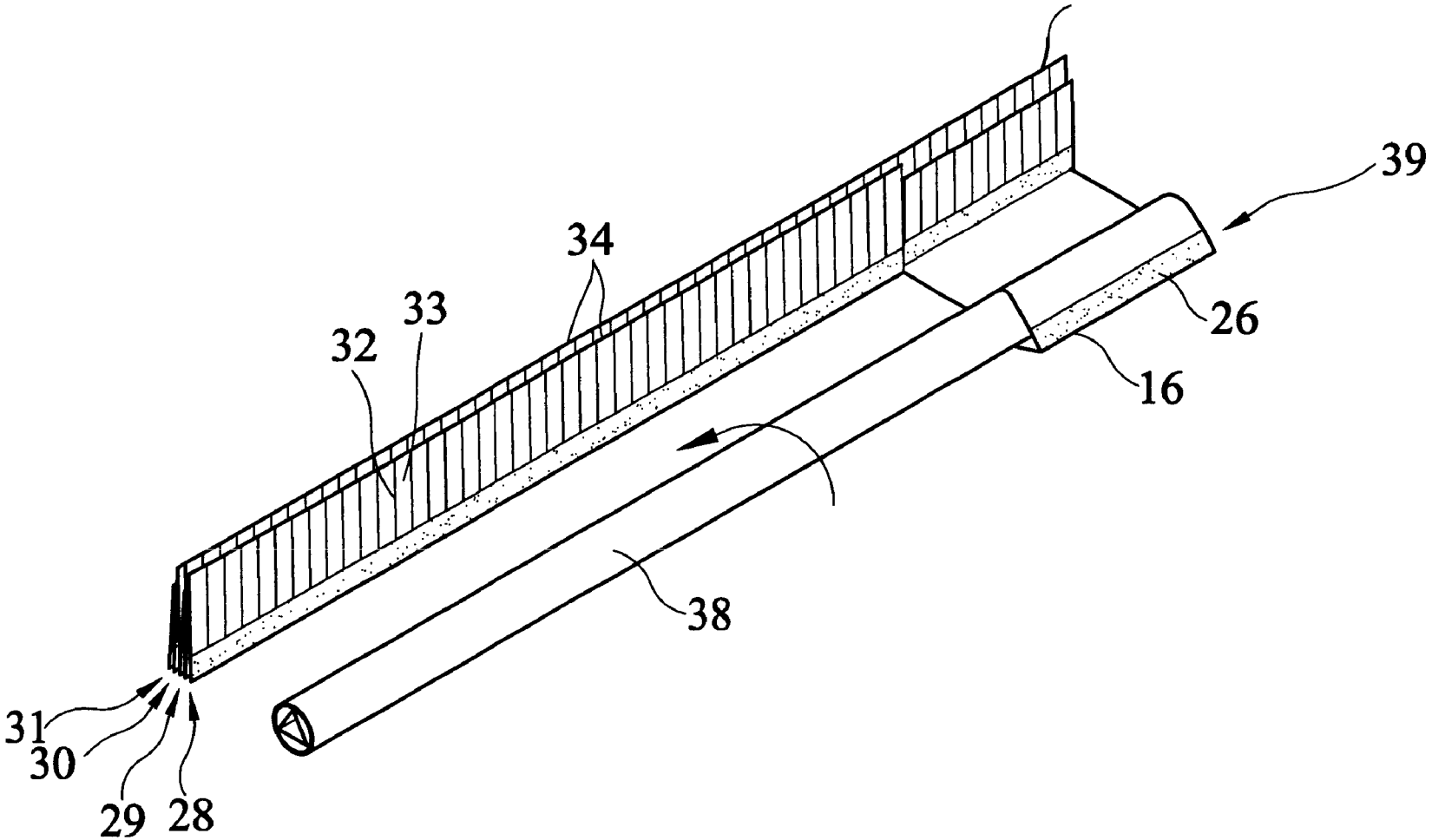
FIG. 7 is a sixth schematic view showing the assembly of the present invention.
Figure 8:
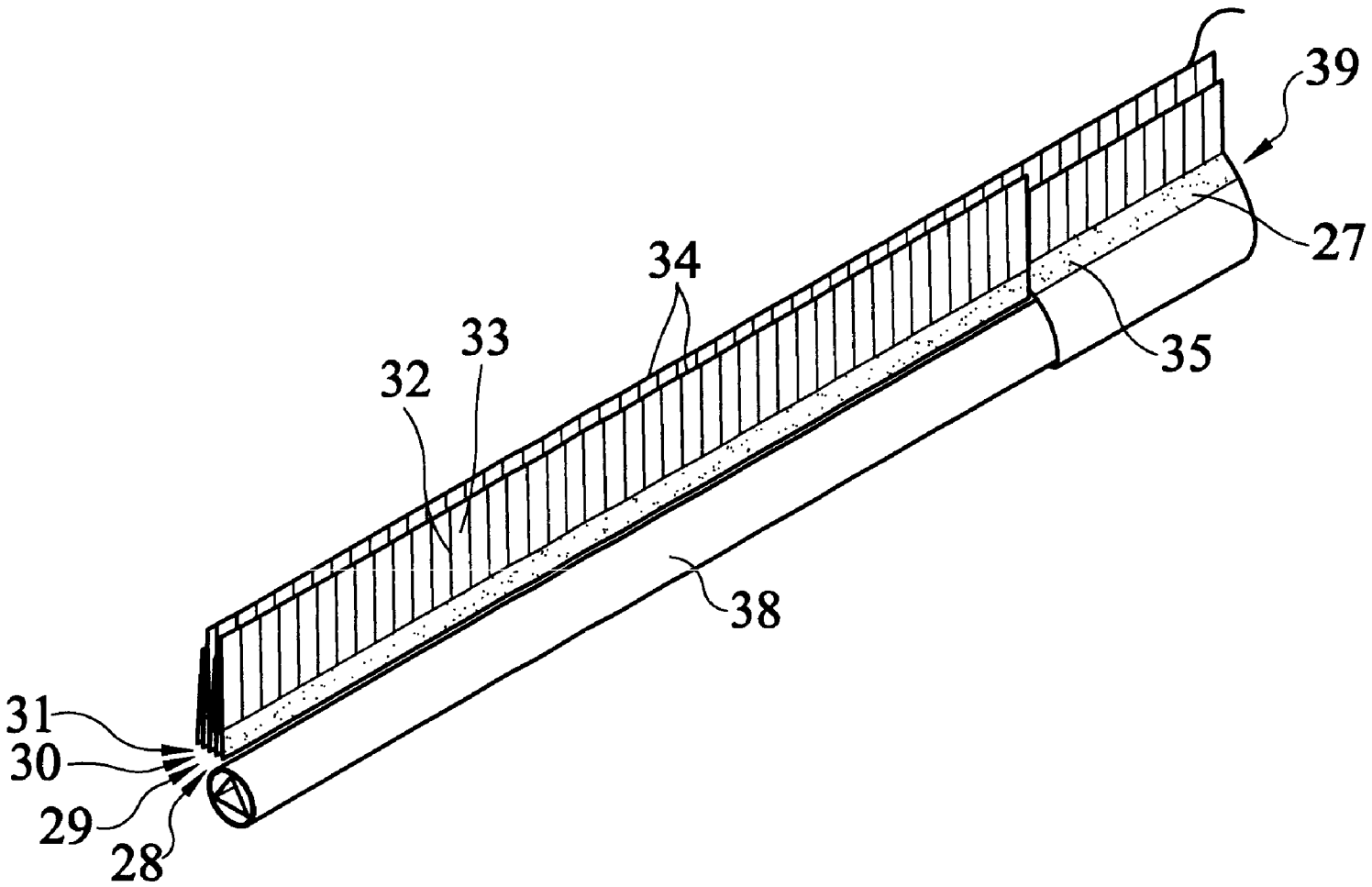
FIG. 8 is a seventh schematic view showing the assembly of the present invention.
Figure 9:
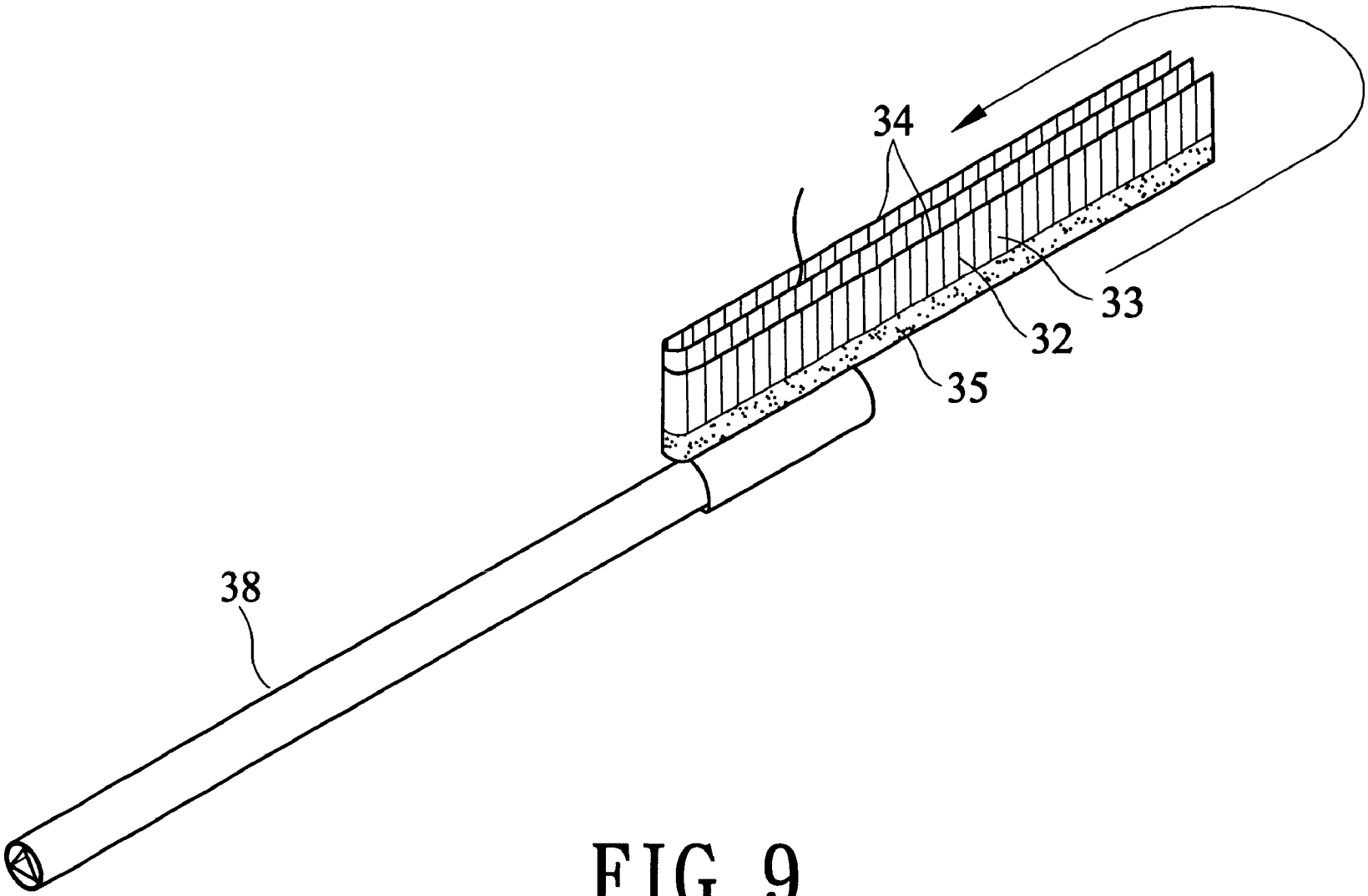
FIG. 9 is a eighth schematic view showing the assembly of the present invention.
Figure 10:
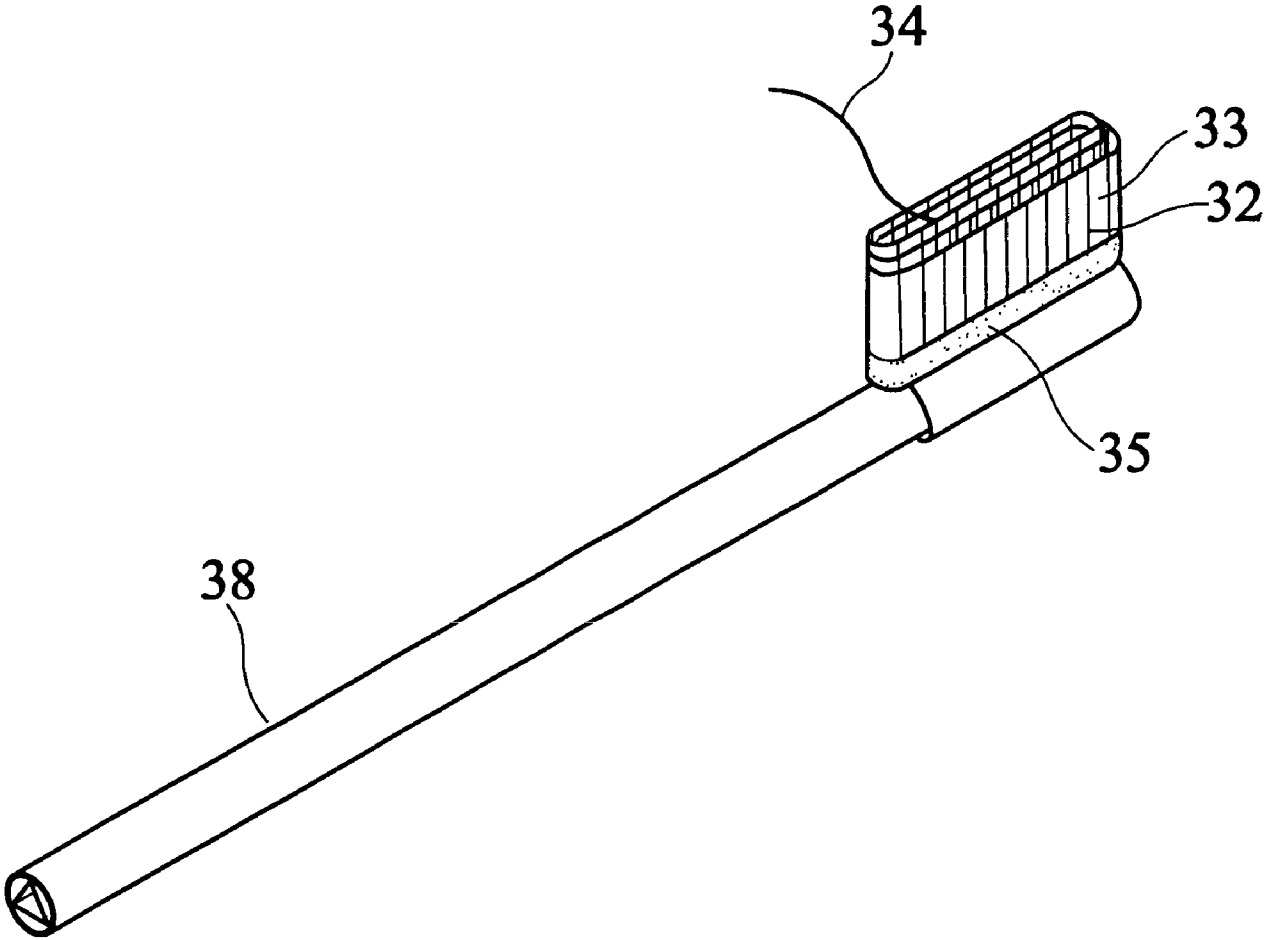
FIG. 10 is a ninth schematic view showing the assembly of the present invention.
Figure 11:
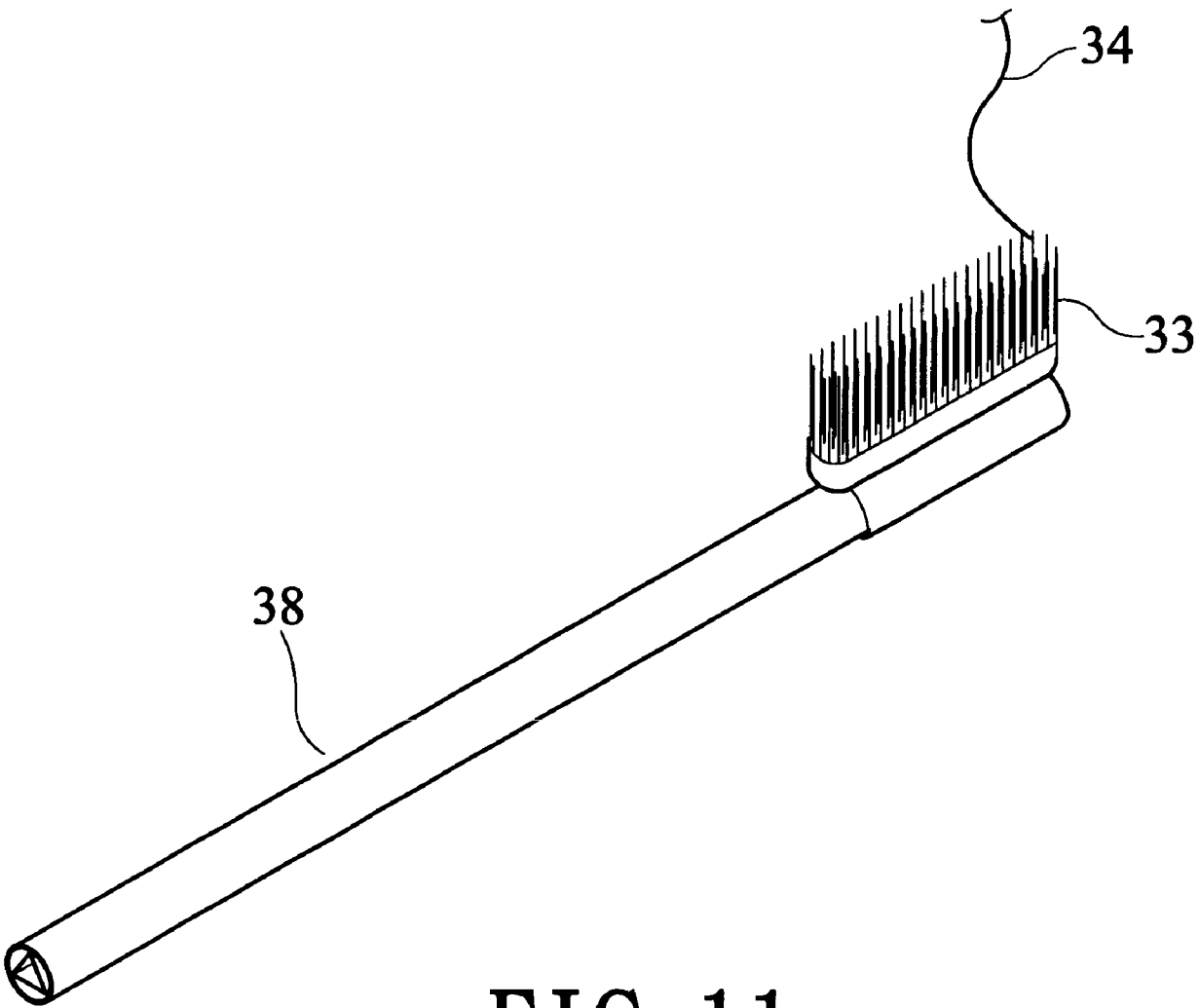
FIG. 11 is a tenth schematic view showing the assembly of the present invention.

With reference to FIGS. 2 and 10, a schematic view showing the assembly of the present invention is illustrated. At first, the first cut line 36 an the second cut line 37 of the plate 10 are torn away, and then the first lateral plate 21, second lateral plate 22, third lateral plate 23, fourth lateral plate 24 and fifth lateral plate 25 are wound toward the same direction by folding along the fold lines 11, 12, 13, and 14 (as shown in FIG. 2). The lateral plants 21, 22, 23 and 24 are bent and wound as a hollow triangular and are fixed by the sticky surface 35. Then the fifth lateral plate 25 is wound to enclosed thereon to be formed as a handle 38 of the toothbrush (as shown in FIG. 3) for being held by a user. It remains to be fixed by the sticky surface 35. Then, the brush hair portions 28, 29, 30, and 31 are bent as a multiple fold shape (as shown in FIGS. 4 and 5), and then are combined together to be formed as a long strip (as shown in FIG. 6). Then, the first protruding plate 26 and the second protruding plate 27 are bent by the fold line 16 so that the first protruding plate 26 and the second protruding plate 27 encloses the front end of the handle 38 so as to be formed as a protruded seat 39 (as shown in FIGS. 7 and 8). Therefore, the long brush hair portions 28, 29, 30 and 31 can be wound and fixedly connected to the outer side of the seat 39 (as shown in FIGS. 9 and 10) and can be fixed by the sticky surface 35. Then, the tooth wire 34 in the brush hair portions 28, 29, 30 and 31 are torn away, then the brush hairs 33 of the brush hair portions 28, 29, 30 and 31 are dispersed (as shown in FIG. 11) for being assembly with a complete card type paper toothbrush. Moreover, the tooth wire 34 can be used.

The present invention is a disposable toothbrush, which can be thrown away after one use. No trouble in health occurs. The present invention is made of a paper plate with a lower molding cost, further, the cost of paper is low. Therefore, the manufacturing cost is reduced greatly. Since the disposable toothbrush is only used once, no waste occurs. furthermore, the paper can be decomposed in a natural environment, no problem of environment pollution occurs. And, before assembling, the present invention is a thin plate and thus only occupies a smaller space, so that it is easily portable.

In summary, by the disposable toothbrush of the present invention, the defects in the present invention, such as high cost, made of plastics, environment pollution, are improved.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invetion as defined in the appended claims.

What is claimed is:

1. A card type paper toothbrush formed by cutting a paper plate to be a plane and then bending the paper plate so as to be formed as a card type paper toothbrush, wherein the paper plate is installed with a plurality of handle fold lines and a plurality of brush hair fold lines which are arranged in parallel, a plurality of lateral plates are formed by the handle fold lines, and a plurality of brush hair portions are spaced by the plurality of brush hair fold lines, each of the brush hair portions are formed with a plurality of brush hair cut lines for cutting the brush hair portions into brush hairs of a toothbrush; the paper plate is further installed with a sticky surface; the lateral plates are wound as a handle by bending along the handle fold lines and then are fixed by the sticky surface, the brush hair portions are formed by bending along the brush hair fold lines, a protruded seat is formed on the handle, the brush hair portions wind around the protruded seat and then are fixed by the sticky surface to thereby form a paper toothbrush.

2. The card type paper toothbrush as claimed in claim 1, wherein a plurality of parallel seat fold lines are formed on the plate, a first protruding plate and a second protruding plate are installed between the seat, the first protruding plate and the second protruding plate are formed between the seat fold lines so that the first protruding plate and the second protruding plate enclose a front end of the handle to form a brush hair seat.

3. The card type paper toothbrush as claimed in claim 1, wherein a tear-able wire is installed on the brush hair portions, the wire penetrates through the brush hair portions so that one end of the wire protrudes from the plate, the wire in the brush hair portions can be torn away so that the brush hair portions are dispersed.

4. The card type paper toothbrush as claimed in claim 1, wherein a first cut line and a second cut line are installed on the plate, the cut lines can be cut for bending and winding the brush hair portions.

* * * * *